US006454000B1

(12) United States Patent
Zupanick

(10) Patent No.: US 6,454,000 B1
(45) Date of Patent: Sep. 24, 2002

(54) CAVITY WELL POSITIONING SYSTEM AND METHOD

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 0 days.

(21) Appl. No.: 09/696,338

(22) Filed: Oct. 24, 2000

Related U.S. Application Data

(63) Continuation-in-part of application No. 09/444,029, filed on Nov. 19, 1999, now Pat. No. 6,357,523.

(51) Int. Cl.[7] ..... E21B 23/00
(52) U.S. Cl. ..... 166/243; 166/105; 166/241.1
(58) Field of Search ..... 166/105–112, 243, 166/241.1; 417/572

(56) References Cited

U.S. PATENT DOCUMENTS

| | | | | |
|---|---|---|---|---|
| 54,144 A | | 4/1866 | Hamar | |
| 130,442 A | * | 8/1872 | Russell | 166/243 |
| 274,740 A | | 3/1883 | Douglass | |
| 526,708 A | | 10/1894 | Horton | |
| 639,036 A | | 12/1899 | Heald | |
| 1,189,560 A | | 7/1916 | Gondos | |
| 1,285,347 A | | 11/1918 | Otto | |
| 1,467,480 A | | 9/1923 | Hogue | |
| 1,485,615 A | | 3/1924 | Jones | |
| 1,674,392 A | | 6/1928 | Flansburg | |
| 1,777,961 A | | 10/1930 | Capeliuschnicoff | |
| 2,018,285 A | | 10/1935 | Schweitzer et al. | 166/21 |
| 2,033,521 A | * | 3/1936 | Horn | 166/237 |
| 2,069,482 A | | 2/1937 | Seay | 255/76 |
| 2,150,228 A | | 3/1939 | Lamb | 166/10 |
| 2,169,718 A | | 8/1939 | Böll et al. | 255/24 |
| 2,335,085 A | | 11/1943 | Roberts | 251/107 |
| 2,450,223 A | | 9/1948 | Barbour | 255/76 |

(List continued on next page.)

FOREIGN PATENT DOCUMENTS

| | | | |
|---|---|---|---|
| DE | 197 25 996 A1 | 1/1998 | E03B/3/10 |
| EP | 0 819 834 A1 | 1/1998 | 43/28 |
| EP | 0 875 661 A1 | 11/1998 | E21B/43/30 |
| EP | 0 952 300 A1 | 10/1999 | E21B/7/12 |
| WO | 94 21889 | 9/1994 | 43/24 |

OTHER PUBLICATIONS

Joseph A. Zupanick; Declaration of Experimental Use with attached exhibits A–D, pp. 1–3, Nov. 14, 2000.
Howard L. Hartman, et al.; "*SME Mining Engineering Handbook*," Society for Mining, Metallurgy, and Exploration, Inc, pp. 1946–1950, 2nd Edition, vol. 2, 1992.
Pending Patent Application, Joseph A. Zupanick, "*Method for Production of Gas From a Coal Seam*," Serial No. 09/197,687, Filed Nov. 20, 1998.

(List continued on next page.)

*Primary Examiner*—David Bagnell
*Assistant Examiner*—John Kreck
(74) *Attorney, Agent, or Firm*—Baker Botts L.L.P.

(57) ABSTRACT

A subterranean cavity positioning system includes a down-hole device and a cavity positioning device rotatably coupled to a well portion of the down-hole device. The cavity positioning device includes a counterbalance portion operable to automatically rotate the cavity positioning device from a retracted position to an extended position as the cavity positioning device transitions from a well bore into the subterranean cavity. The counterbalance portion is also operable to align the cavity positioning device with the well bore as the down-hole device is withdrawn from the subterranean cavity.

16 Claims, 8 Drawing Sheets

U.S. PATENT DOCUMENTS 2,490,350 A 12/1949 Grable ..... 166/4
2,679,903 A 6/1954 McGowen, Jr. et al. ..... 166/1
2,726,063 A 12/1955 Ragland et al. ..... 255/1.8
2,783,018 A 2/1957 Lytle ..... 251/25
2,847,189 A 8/1958 Shook ..... 255/76
2,911,008 A 11/1959 Du Bois ..... 137/625.31
2,980,142 A 4/1961 Turak ..... 137/637.3
3,107,731 A * 10/1963 Dinning ..... 166/217
3,347,595 A 10/1967 Dahms et al. ..... 299/4
3,443,648 A 5/1969 Howard ..... 175/103
3,473,571 A 10/1969 Dugay ..... 137/625.4
3,503,377 A 3/1970 Beatenbough et al. ..... 123/117
3,528,516 A 9/1970 Brown ..... 175/267
3,530,675 A 9/1970 Turzillo ..... 61/35
3,684,041 A 8/1972 Kammerer, Jr. et al. .... 175/267
3,692,041 A 9/1972 Bondi ..... 137/238
3,757,876 A 9/1973 Pereau ..... 175/267
3,757,877 A 9/1973 Leathers ..... 175/269
3,800,830 A 4/1974 Etter ..... 137/625.41
3,809,519 A 5/1974 Garner ..... 425/245
3,828,867 A 8/1974 Elwood ..... 175/45
3,874,413 A 4/1975 Valdez ..... 137/625.47
3,902,322 A 9/1975 Watanabe ..... 61/35
3,934,649 A 1/1976 Pasini, III et al. ..... 166/254
3,957,082 A 5/1976 Fuson et al. ..... 137/625.41
3,961,824 A 6/1976 Van Eek et al. ..... 299/17
4,037,658 A 7/1977 Anderson ..... 166/272
4,073,351 A 2/1978 Baum ..... 175/14
4,089,374 A 5/1978 Terry ..... 166/259
4,116,012 A 9/1978 Abe et al. ..... 405/238
4,156,437 A 5/1979 Chivens et al. ..... 137/554
4,169,510 A 10/1979 Meigs ..... 175/65
4,189,184 A 2/1980 Green ..... 299/8
4,220,203 A 9/1980 Steeman ..... 166/271
4,221,433 A 9/1980 Jacoby ..... 299/4
4,257,650 A 3/1981 Allen ..... 299/2
4,278,137 A 7/1981 Van Eek ..... 175/267
4,296,785 A 10/1981 Vitello et al. ..... 414/105
4,299,295 A 11/1981 Gossard ..... 175/45
4,312,377 A 1/1982 Knecht ..... 137/625.19
4,317,492 A 3/1982 Summers et al. ..... 175/79
4,366,988 A 1/1983 Bodine ..... 299/14
4,372,398 A 2/1983 Kuckes ..... 175/45
4,390,067 A 6/1983 Willman ..... 166/245
4,396,076 A 8/1983 Inoue ..... 175/265
4,397,360 A 8/1983 Schmidt ..... 175/61
4,401,171 A 8/1983 Fuchs ..... 175/267
4,407,376 A 10/1983 Inoue ..... 175/267
4,442,896 A 4/1984 Reale et al. ..... 166/278
4,494,616 A 1/1985 McKee ..... 175/67
4,512,422 A 4/1985 Knisley ..... 175/99
4,527,639 A 7/1985 Dickinson, III et al. ..... 175/61
4,532,986 A 8/1985 Mims et al. ..... 166/50
4,544,037 A 10/1985 Terry ..... 166/369
4,558,744 A 12/1985 Gibb ..... 166/335
4,565,252 A 1/1986 Campbell, et al. ..... 175/269
4,600,061 A 7/1986 Richards ..... 175/62
4,605,076 A 8/1986 Goodhart ..... 175/61
4,611,855 A 9/1986 Richards ..... 299/2
4,618,009 A 10/1986 Carter et al. ..... 175/267
4,638,949 A 1/1987 Mancel ..... 239/307
4,674,579 A 6/1987 Geller et al. ..... 175/45
4,702,314 A 10/1987 Huang et al. ..... 166/245
4,715,440 A 12/1987 Boxell et al. ..... 166/100
4,763,734 A 8/1988 Dickinson et al. ..... 175/62
4,830,105 A 5/1989 Petermann ..... 166/241
4,842,081 A 6/1989 Parant ..... 175/23
4,852,666 A 8/1989 Brunet et al. ..... 175/61
4,978,172 A 12/1990 Schwoebel et al. ..... 299/12
5,016,710 A 5/1991 Renard et al. ..... 166/245
5,035,605 A 7/1991 Dinerman et al. ..... 425/564
5,036,921 A 8/1991 Pittard et al. ..... 166/298
5,074,360 A 12/1991 Guinn ..... 166/281
5,074,365 A 12/1991 Kuckes ..... 175/40
5,074,366 A 12/1991 Karlsson et al. ..... 175/76
5,111,893 A 5/1992 Kvello-Aune ..... 175/258
5,135,058 A 8/1992 Millgard et al. ..... 175/71
5,148,875 A 9/1992 Karlsson et al. ..... 175/62
5,168,942 A 12/1992 Wydrinski ..... 175/50
5,174,374 A 12/1992 Hailey ..... 166/55.8
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,240,350 A 8/1993 Yamaguchi et al. ..... 405/143
5,242,017 A 9/1993 Hailey ..... 166/55.8
5,246,273 A 9/1993 Rosar ..... 299/4
5,255,741 A 10/1993 Alexander ..... 166/278
5,271,472 A 12/1993 Leturno ..... 175/107
5,301,760 A 4/1994 Graham ..... 175/61
5,363,927 A 11/1994 Frank ..... 175/67
5,385,205 A 1/1995 Hailey ..... 166/55.8
5,402,851 A 4/1995 Baiton ..... 166/369
5,411,085 A 5/1995 Moore et al. ..... 166/242
5,411,104 A 5/1995 Stanley ..... 175/65
5,450,902 A 9/1995 Matthews ..... 166/268
5,454,419 A 10/1995 Vloedman ..... 166/277
5,462,116 A 10/1995 Carroll ..... 166/249
5,469,155 A 11/1995 Archambeault et al. . 340/853.4
5,485,089 A 1/1996 Kuckes ..... 324/346
5,494,121 A 2/1996 Nackerud ..... 175/263
5,501,273 A 3/1996 Puri ..... 166/252.5
5,501,279 A 3/1996 Garg et al. ..... 166/372
5,584,605 A 12/1996 Beard et al. ..... 405/128
5,615,739 A 4/1997 Dallas ..... 166/306
5,659,347 A 8/1997 Taylor ..... 347/85
5,669,444 A 9/1997 Riese et al. ..... 166/263
5,690,390 A 11/1997 Bithell ..... 299/4
5,706,871 A 1/1998 Andersson et al. ..... 141/59
5,720,356 A 2/1998 Gardes ..... 175/62
5,785,133 A 7/1998 Murray et al. ..... 175/61
5,832,958 A 11/1998 Cheng ..... 137/625.41
5,853,054 A 12/1998 McGarian et al. ..... 175/267
5,868,202 A 2/1999 Hsu ..... 166/256
5,868,210 A 2/1999 Johnson et al. ..... 175/40
5,879,057 A 3/1999 Schwoebel et al. ..... 299/17
5,917,325 A 6/1999 Smith ..... 324/326
5,934,390 A 8/1999 Uthe ..... 175/67
5,957,539 A 9/1999 Durup et al. ..... 299/4
6,024,171 A 2/2000 Montgomery et al. ..... 166/308

OTHER PUBLICATIONS

Pending Patent Application, Joseph A. Zupanick, "*Method and System for Accessing Subterranean Deposits From The Surface*," Serial No. 09/444,029, Filed Nov. 19, 1999.

Pending Patent Application, Joseph A. Zupanick, "*Method and System for Accessing Subterranean Deposits From The Surface*," Serial NO. 09/789,956, Filed Feb. 20, 1999.

Pending Patent Application, Joseph A. Zupanick, "*Method and System for Accessing Subterranean Deposits From The Surface*," Serial No. 09/788,897, Filed Feb. 20, 2001.

Pending Patent Application, Joseph A. Zupanick, "*Method and System for Accessing Subterranean Deposits From The Surface*," Serial No. 09/791,033, Filed 20, 2001.

Pending Patent Application, Joseph A. Zupanick, *Method and System for Enhanced Access to a Subterrean Zone*, Serial No. 09/769,098, Jan. 24, 2001.

Pending Patent Application, Joseph A. Zupanick, *Method and System for Accessing a Subterrean Zone form a Limited Surface Area*, Serial No. 09/774,996, Jan. 30, 2001.
Pending Patent Application, Joseph A. Zupanick, *Method and System for Accessing a Subterrean Zone from a Limited Surface Area*, Serial No. 09/773,217, Jan. 30, 2001.
PCT Search Report dated May 7, 2000.
Dave Hassan, Mike Chernichen, Earl Jensen, and Morley Frank; "Multi–lateral technique lowers drilling costs, provides environmental benefits", Drilling Technology, pp. 41–47, Oct. 1999.

* cited by examiner

CAVITY WELL POSITIONING SYSTEM AND METHOD

RELATED APPLICATIONS

This application is a continuation-in-part of patent application Ser. No. 09/444,029 filed Nov. 19, 1999, now U.S. Pat. No. 6,357,523 and entitled "Method And System For Accessing Subterranean Deposits From The Surface."

TECHNICAL FIELD OF THE INVENTION

The present invention relates generally to systems and methods for the recovery of subterranean resources and, more particularly, to a cavity well positioning system and method.

BACKGROUND OF THE INVENTION

Subterranean deposits of coal contain substantial quantities of entrained methane gas limited in production in use of methane gas from coal deposits has occurred for many years. Substantial obstacles, however, have frustrated more extensive development and use of methane gas deposits in coal seams. The foremost problem in producing methane gas from coal seams is that while coal seams may extend over large areas of up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amenable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Horizontal drilling patterns have been tried in order to extend the amount of coal seams exposed to a drill bore for gas extraction. Such horizontal drilling techniques, however, require the use of a radiused well bore which presents difficulties in removing the entrained water from the coal seam. The most efficient method for pumping water from a subterranean well, a sucker rod pump, does not work well in horizontal or radiused bores.

A further problem for surface production of gas from coal seams is the difficulty presented by under balanced drilling conditions caused by the porousness of the coal seam. During both vertical and horizontal surface drilling operations, drilling fluid is used to remove cuttings from the well bore to the surface. The drilling fluid exerts a hydrostatic pressure on the formation which, if it exceeds the hydrostatic pressure of the formation, can result in a loss of drilling fluid into the formation. This results in entrainment of drilling finds in the formation, which tends to plug the pores, cracks, and fractures that are needed to produce the gas.

As a result of these difficulties in surface production of methane gas from coal deposits, the methane gas which must be removed from a coal seam prior to mining, has been removed from coal seams through the use of subterranean methods. While the use of subterranean methods allows water to be easily removed from a coal seam and eliminates under balanced drilling conditions, they can only access a limited amount of the coal seams exposed by current mining operations. Where longwall mining is practiced, for example, underground drilling rigs are used to drill horizontal holes from a panel currently being mined into an adjacent panel that will later be mined. The limitations of underground rigs limits the reach of such horizontal holes and thus the area that can be effectively drained. In addition, the degasification of a next panel during mining of a current panel limits the time for degasification. As a result, many horizontal bores must be drilled to remove the gas in a limited period of time. Furthermore, in conditions of high gas content or migration of gas through a coal seam, mining may need to be halted or delayed until a next panel can be adequately degasified. These production delays add to the expense associated with degasifying a coal seam.

Additionally, precisely locating and securing downhole equipment, such as pumping units for removing water from the coal seam in order to produce the methane, in a well bore is difficult. For example, various alignment tools are generally used to locate the equipment at a desired location and locking mechanisms are actuated to secure the equipment at the desired location. The locking mechanisms must then be unlocked to accommodate retrieval of the equipment from the well bore. Malfunctions of the alignment tools and locking mechanisms results in delay and, oftentimes, repeated mining procedures.

SUMMARY OF THE INVENTION

The present invention provides a cavity well positioning system and method for positioning down-hole pumps and equipment within a subterranean cavity that substantially eliminates or reduces the disadvantages and problems associated with previous systems and methods. In particular, the present invention provides a cavity well positioning system and method for efficiently positioning and removing down-hole equipment from within a subterranean cavity 20 without requiring additional locking, unlocking or alignment tools to facilitate the positioning and withdrawal of down-hole equipment.

In accordance with one embodiment of the present invention, a subterranean cavity positioning system includes a down-hole device and a cavity positioning device rotatably coupled to a well portion of the down-hole device. The cavity positioning device includes a counterbalance portion operable to automatically rotate the cavity positioning device from a retracted position to an extended position as the cavity positioning device transitions from a well bore into the subterranean cavity. The counterbalance portion is also operable to align the cavity positioning device with the well bore as the down-hole device is withdrawn from the subterranean cavity.

According to another embodiment of the present invention, a method for automatically positioning and retrieving down-hole equipment in a subterranean cavity includes providing a cavity positioning device coupled to a well bore portion of a down-hole device and deploying the down-hole device and the cavity positioning device into a well bore. The cavity positioning device is disposed in a retracted position relative to the well bore. The method also includes running the down-hole device and the cavity positioning device downwardly within the well bore to the cavity. The cavity positioning device automatically transitions to an extended position relative to the well bore in the cavity. The method further includes positioning the down-hole device at a predefined location in the cavity by contacting a portion of the cavity with the cavity positioning device.

Technical advantages of the present invention include providing a positioning system for automatically positioning down-hole pumps and other equipment in a cavity. In particular, a rotatable cavity positioning device is configured to retract for transport in a well bore and to extend within a down-hole cavity to optimally position the equipment within the cavity. This allows down-hole equipment to be easily positioned and secured within the cavity.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
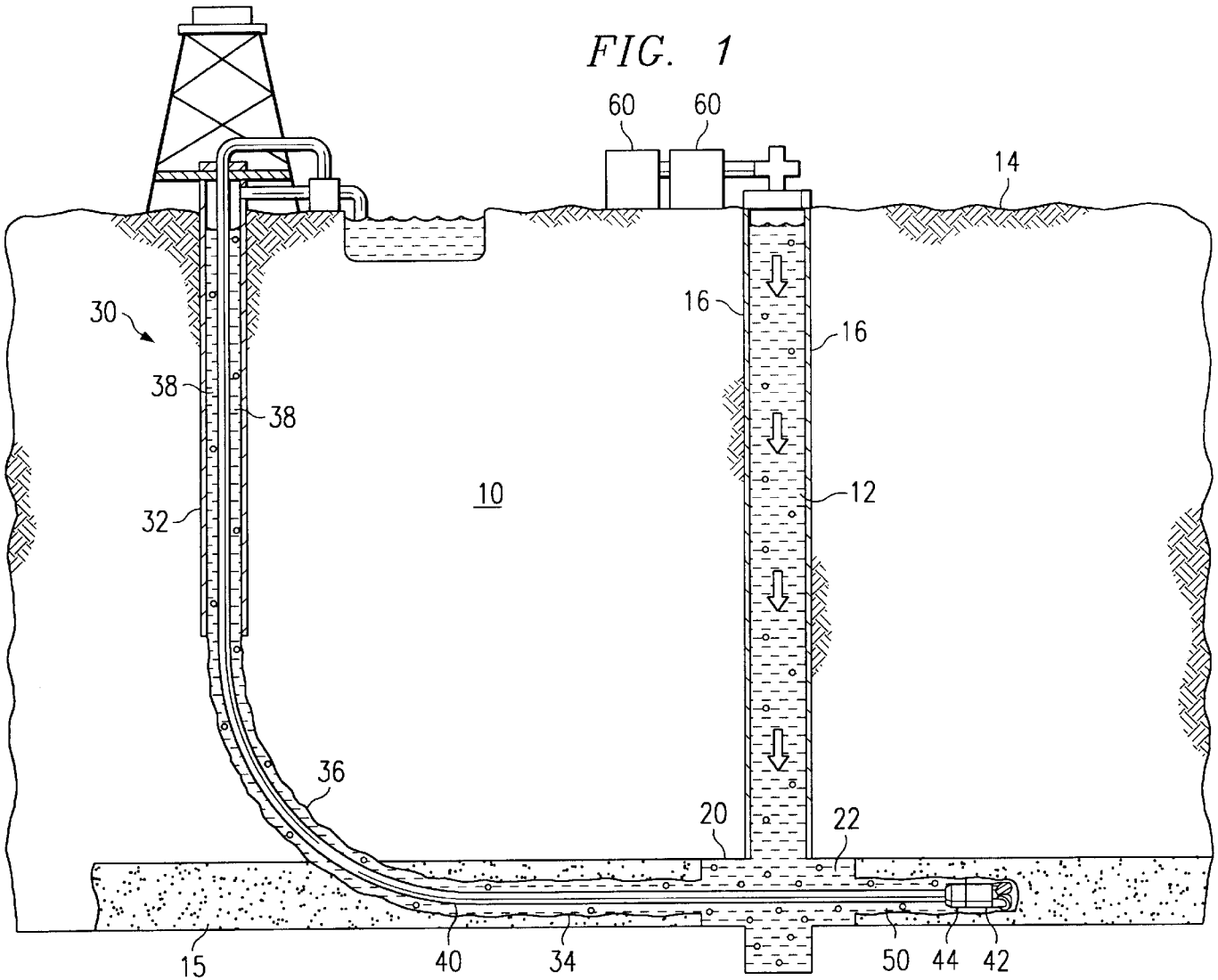
FIG. 1 is a cross-sectional diagram illustrating formation of a horizontal drainage pattern in a subterranean zone through an articulated surface well intersecting a vertical cavity well in accordance with one embodiment of the present invention.

FIG. 1 illustrates a cavity and articulated well combination for accessing a subterranean zone from the surface in accordance with one embodiment of the present invention. In this embodiment,.the subterranean zone is a coal seam. It will be understood that other low pressure, ultra-low pressure, and low porosity subterranean zones can be similarly accessed using the dual well system of the present invention to remove and/or produce water, hydrocarbons and other fluids in the zone and to treat minerals in the zone prior to mining operations.

Referring to FIG. 1, a substantially vertical well bore 12 extends from the surface 14 to a target coal seam 15. The substantially vertical well bore 12 intersects, penetrates and continues below the coal seam 15. The substantially vertical well bore is lined with a suitable well casing 16 that terminates at or above the level of the coal seam 15.

The substantially vertical well bore 12 is logged either during or after drilling in order to locate the exact vertical depth of the coal seam 15. As a result, the coal seam is not missed in subsequent drilling operations and techniques used to locate the seam 15 while drilling need not be employed. An enlarged diameter cavity 20 is formed in the substantially vertical well bore 12 at the level of the coal seam 15. As described in more detail below, the enlarged diameter cavity 20 provides a junction for intersection of the substantially vertical well bore by articulated well bore used to form a substantially horizontal drainage pattern in the coal seam 15. The enlarged diameter cavity 20 also provides a collection point for fluids drained from the coal seam 15 during production operations.

In one embodiment, the enlarged diameter cavity 20 has a radius of approximately eight feet and a vertical dimension which equals or exceeds the vertical dimension of the coal seam 15. The enlarged diameter cavity 20 is formed using suitable under-reaming techniques and equipment. A vertical portion of the substantially vertical well bore 12 continues below the enlarged diameter cavity 20 to form a sump 22 for the cavity 20.

An articulated well bore 30 extends from the surface 14 to the enlarged diameter cavity 20 of the substantially vertical well bore 12. The articulated well bore 30 includes a substantially vertical portion 32, a substantially horizontal portion 34, and a curved or radiused portion 36 interconnecting the vertical and horizontal portions 32 and 34. The horizontal portion 34 lies substantially in the horizontal plane of the coal seam 15 and intersects the large diameter cavity 20 of the substantially vertical well bore 12.

The articulated well bore 30 is offset a sufficient distance from the substantially vertical well bore 12 at the surface 14 to permit the large radius curved section 36 and any desired horizontal section 34 to be drilled before intersecting the enlarged diameter cavity 20. To provide the curved portion 36 with a radius of 100–150 feet, the articulated well bore 30 is offset a distance of about 300 feet from the substantially vertical well bore 12. This spacing minimizes the angle of the curved portion 36 to reduce friction in the bore 30 during drilling operations. As a result, reach of the articulated drill string drilled through the articulated well bore 30 is maximized.

The articulated well bore 30 is drilled using articulated drill string 40 that includes a suitable down-hole motor and bit 42. A measurement while drilling (MWD) device 44 is included in the articulated drill string 40 for controlling the orientation and direction of the well bore drilled by the motor and bit 42. The substantially vertical portion 32 of the articulated well bore 30 is lined with a suitable casing 38.

After the enlarged diameter cavity 20 has been successfully intersected by the articulated well bore 30, drilling is continued through the cavity 20 using the articulated drill string 40 and appropriate horizontal drilling apparatus to provide a substantially horizontal drainage pattern 50 in the coal seam 15. The substantially horizontal drainage pattern 50 and other such well bores include sloped, undulating, or other inclinations of the coal seam 15 or other subterranean zone. During this operation, gamma ray logging tools and conventional measurement while drilling devices may be employed to control and direct the orientation of the drill bit to retain the drainage pattern 50 within the confines of the coal seam 15 and to provide substantially uniform coverage of a desired area within the coal seam 15. Further information regarding the drainage pattern is described in more detail below in connection with FIGS. 4–7.

During the process of drilling the drainage pattern 50, drilling fluid or "mud" is pumped down the articulated drill string 40 and circulated out of the drill string 40 in the vicinity of the bit 42, where it is used to scour the formation and to remove formation cuttings. The cuttings are then entrained in the drilling fluid which circulates up through the annulus between the drill string 40 and the well bore walls until it reaches the surface 14, where the cuttings are removed from the drilling fluid and the fluid is then recirculated. This conventional drilling operation produces a standard column of drilling fluid having a vertical height equal to the depth of the well bore 30 and produces a hydrostatic pressure on the well bore corresponding to the well bore depth. Because coal seams tend to be porous and fractured, they may be unable to sustain such hydrostatic pressure, even if formation water is also present in the coal seam 15. Accordingly, if the full hydrostatic pressure is allowed to act on the coal seam 15, the result may be loss of drilling fluid and entrained cuttings into the formation. Such a circumstance is referred to as an "over balanced" drilling operation in which the hydrostatic fluid pressure in the well bore exceeds the ability of the formation to withstand the pressure. Loss of drilling fluids in cuttings into the formation not only is expensive in terms of the lost drilling fluids, which must be made up, but it tends to plug the pores in the coal seam 15, which are needed to drain the coal seam of gas and water.

To prevent over balance drilling conditions during formation of the drainage pattern 50, air compressors 60 are provided to circulate compressed air down the substantially vertical well bore 12 and back up through the articulated well bore 30. The circulated air will admix with the drilling fluids in the annulus around the articulated drill string 40 and create bubbles throughout the column of drilling fluid. This has the effective of lightening the hydrostatic pressure of the drilling fluid and reducing the down-hole pressure sufficiently that drilling conditions do not become over balanced. Aeration of the drilling fluid reduces down-hole pressure to approximately 150–200 pounds per square inch (psi). Accordingly, low pressure coal seams and other subterranean zones can be drilling without substantial loss of drilling fluid and contamination of the zone by the drilling fluid.

Foam, which may be compressed air mixed with water, may also be circulated down through the articulated drill string 40 along with the drilling mud in order to aerate the drilling fluid in the annulus as the articulated well bore 30 is being drilled and, if desired, as the drainage pattern 50 is being drilled. Drilling of the drainage pattern 50 with the use of an air hammer bit or an air-powered down-hole motor will also supply compressed air or foam to the drilling fluid. In this case, the compressed air or foam which is used to power the bit or down-hole motor exits the vicinity of the drill bit 42. However, the larger volume of air which can be circulated down the substantially vertical well bore 12, permits greater aeration of the drilling fluid than generally is possible by air supplied through the articulated drill string 40.

Figure 2:
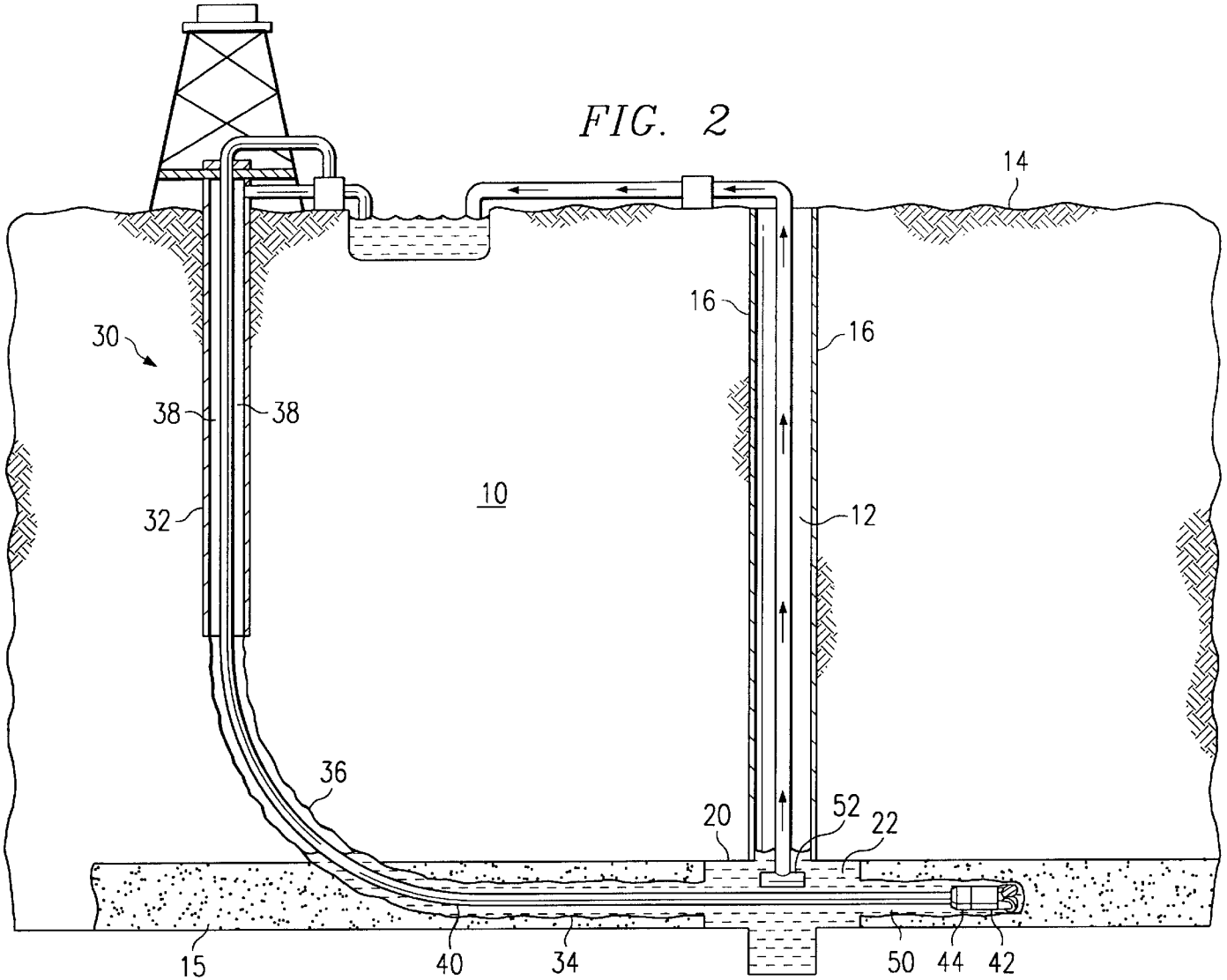
FIG. 2 is a cross-sectional diagram illustrating formation of the horizontal drainage pattern in the subterranean zone through the articulated surface well intersecting the vertical cavity well in accordance with another embodiment of the present invention.

FIG. 2 illustrates method and system for drilling the drainage pattern 50 in the coal seam 15 in accordance with another embodiment of the present invention. In this embodiment, the substantially vertical well bore 12, enlarged diameter cavity 20 and articulated well bore 32 are positioned and formed as previously described in connection with the FIG. 1.

Referring to FIG. 2, after intersection of the enlarged diameter cavity 20 by the articulated well bore 30 a pump 52 is installed in the enlarged diameter cavity 20 to pump drilling fluid and cuttings to the surface 14 through the substantially vertical well bore 12. This eliminates the friction of air and fluid returning up the articulated well bore 30 and reduces down-hole pressure to nearly zero. Accordingly, coal seams and other subterranean zones having ultra low pressures below 150 psi can be accessed from the-surface. Additionally, the risk of combining air and methane in the well is eliminated.

Figure 3:
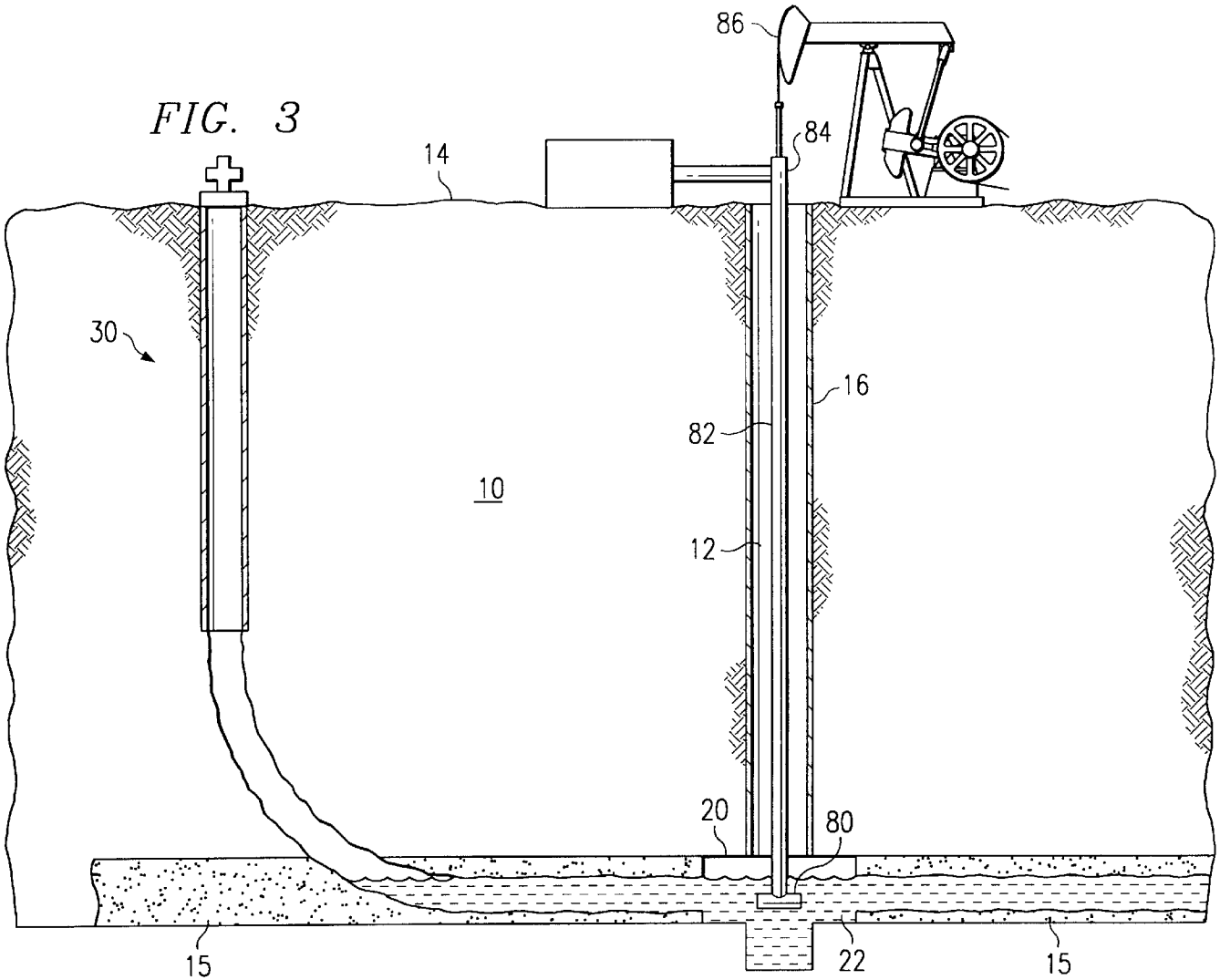
FIG. 3 is a cross-sectional diagram illustrating production of fluids from a horizontal draining pattern in a subterranean zone through a vertical well bore in accordance with one embodiment of the present invention.

FIG. 3 illustrates production of fluids from the horizontal drainage pattern 50 in the coal seam 15 in accordance with one embodiment of the present invention. In this embodiment, after the substantially vertical and articulated well bores 12 and 30 as well as desired drainage pattern 50 have been drilled, the articulated drill string 40 is removed from the articulated well bore 30 and the articulated well bore is capped. For multiple pinnate structure described below, the articulated well 30 may be plugged in the substantially horizontal portion 34. Otherwise, the articulated well 30 may be left unplugged.

Referring to FIG. 3, a down hole pump 80 is disposed in the substantially vertical well bore 12 in the enlarged diameter cavity 22. The enlarged cavity 20 provides a reservoir for accumulated fluids allowing intermittent pumping without adverse effects of a hydrostatic head caused by accumulated fluids in the well bore.

The down hole pump 140 is connected to the surface 14 via a tubing string 82 and may be powered by sucker rods 84 extending down through the well bore 12 of the tubing. The sucker rods 84 are reciprocated by a suitable surface mounted apparatus, such as a powered walking beam 86 to operate the down hole pump 80. The down hole pump 80 is used to remove water and entrained coal fines from the coal seam 15 via the drainage pattern 50. Once the water is removed to the surface, it may be treated for separation of methane which may be dissolved in the water and for removal of entrained fines. After sufficient water has been removed from the coal seam 15, pure coal seam gas may be allowed to flow to the surface 14 through the annulus of the substantially vertical well bore 12 around the tubing string 82 and removed via piping attached to a wellhead apparatus. At the surface, the methane is treated, compressed and pumped through a pipeline for use as a fuel in a conventional manner. The down hole pump 80 may be operated continuously or as needed to remove water drained from the coal seam 15 into the enlarged diameter cavity 22.

FIGS. 4–7 illustrate substantially horizontal drainage patterns 50 for accessing the coal seam 15 or other subterranean zone in accordance with one embodiment of the present invention. In this embodiment, the drainage patterns comprise pinnate patterns that have a central diagonal with generally symmetrically arranged and appropriately spaced laterals extending from each side of the diagonal. The pinnate pattern approximates the pattern of veins in a leaf or the design of a feather in that it has similar, substantially parallel, auxiliary drainage bores arranged in substantially equal and parallel spacing or opposite sides-of an axis. The pinnate drainage pattern with its central bore and generally symmetrically arranged and appropriately spaced auxiliary drainage bores on each side provides a uniform pattern for draining fluids from a coal seam or other subterranean formation. As described in more detail below, the pinnate pattern provides substantially uniform coverage of a square, other quadrilateral, or grid area and may be aligned with longwall mining panels for preparing the coal seam 15 for mining operations. It will be understood that other suitable drainage patterns may be used in accordance with the present invention.

The pinnate and other suitable drainage patterns drilled from the surface provide surface access to subterranean formations. The drainage pattern may be used to uniformly remove and/or insert fluids or otherwise manipulate a subterranean deposit. In non coal applications, the drainage pattern may be used initiating in-situ burns, "huff-puff" steam operations for heavy crude oil, and the removal of hydrocarbons from low porosity reservoirs.

Figure 4:
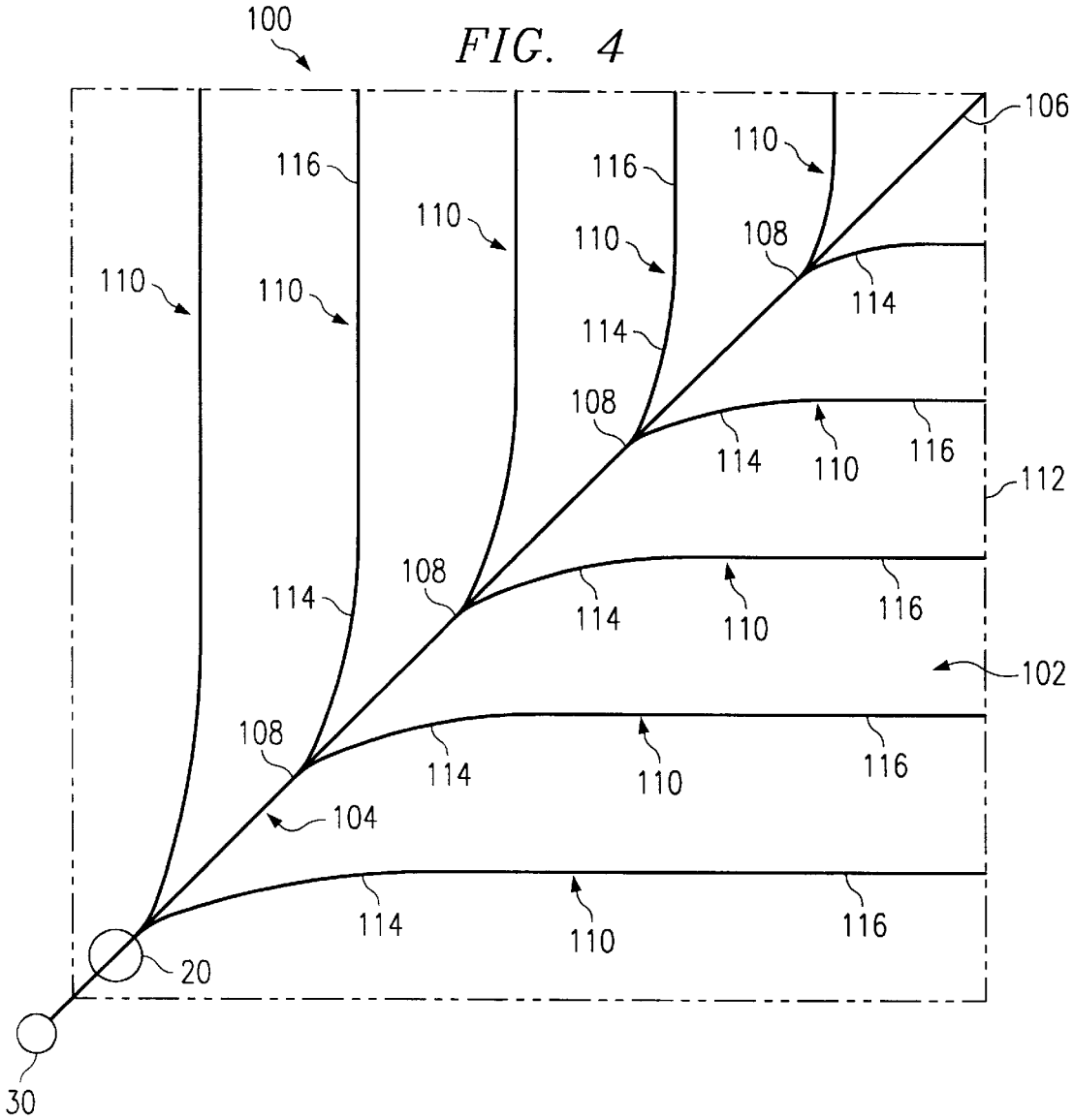
FIG. 4 is a top plan diagram illustrating a pinnate drainage pattern for accessing deposits in a subterranean zone in accordance with one embodiment of the present invention.

FIG. 4 illustrates a pinnate drainage pattern 100 in accordance with one embodiment of the present invention. In this embodiment, the pinnate drainage pattern 100 provides access to a substantially square area 102 of a subterranean zone. A number of the pinnate patterns 60 may be used together to provide uniform access to a large subterranean region.

Referring to FIG. 4, the enlarged diameter cavity 20 defines a first corner of the area 102. The pinnate pattern 100 includes a substantially horizontal main well bore 104 extending diagonally across the area 102 to a distant corner 106 of the area 102. Preferably, the substantially vertical and articulated well bores 12 and 30 are positioned over the area 102 such that the diagonal bore 104 is drilled up the slope of the coal seam 15. This will facilitate collection of water, gas from the area 102. The diagonal bore 104 is drilled using the articulated drill string 40 and extends from the enlarged cavity 20 in alignment with the articulated well bore 30.

A plurality of lateral well bores 110 extend from the opposites sides of diagonal bore 104 to a periphery 112 of the area 102. The lateral bores 122 may mirror each other on opposite sides of the diagonal bore 104 or may be offset from each other along the diagonal bore 104. Each of the lateral bores 110 includes a radius curving portion 114 coming off of the diagonal bore 104 and an elongated portion 116 formed after the curved portion 114 has reached a desired orientation. For uniform coverage of the square area 102, pairs of lateral bores 110 are substantially evenly spaced on each side of the diagonal bore 104 and extend from the diagonal 64 at an angle of approximately 45 degrees. The lateral bores 110 shorten in length based on progression away from the enlarged diameter cavity 20 in order to facilitate drilling of the lateral bores 110.

The pinnate drainage pattern 100 using a single diagonal bore 104 and five pairs of lateral bores 110 may drain a coal seam area of approximately 150 acres in size. Where a smaller area is to be drained, or where the coal seam has a different shape, such as a long, narrow shape or due to surface or subterranean topography, alternate pinnate drainage patterns may be employed by varying the angle of the lateral bores 110 to the diagonal bore 104 and the orientation of the lateral bores 110. Alternatively, lateral bores 120 can be drilled from only one side of the diagonal bore 104 to form a one-half pinnate pattern.

The diagonal bore 104 and the lateral bores 110 are formed by drilling through the enlarged diameter cavity 20 using the articulated drill string 40 and appropriate horizontal drilling apparatus. During this operation, gamma ray logging tools and conventional measurement while drilling technologies may be employed to control the direction and orientation of the drill bit so as to retain the drainage pattern within the confines of the coal seam 15 and to maintain proper spacing and orientation of the diagonal and lateral bores 104 and 110.

In a particular embodiment, the diagonal bore 104 is drilled with an incline at each of a plurality of lateral kick-off points 108. After the diagonal 104 is complete, the articulated drill string 40 is backed up to each successive lateral point 108 from which a lateral bore 110 is drilled on each side of the diagonal 104. It will be understood that the pinnate drainage pattern 100 may be otherwise suitably formed in accordance with the present invention.

Figure 5:
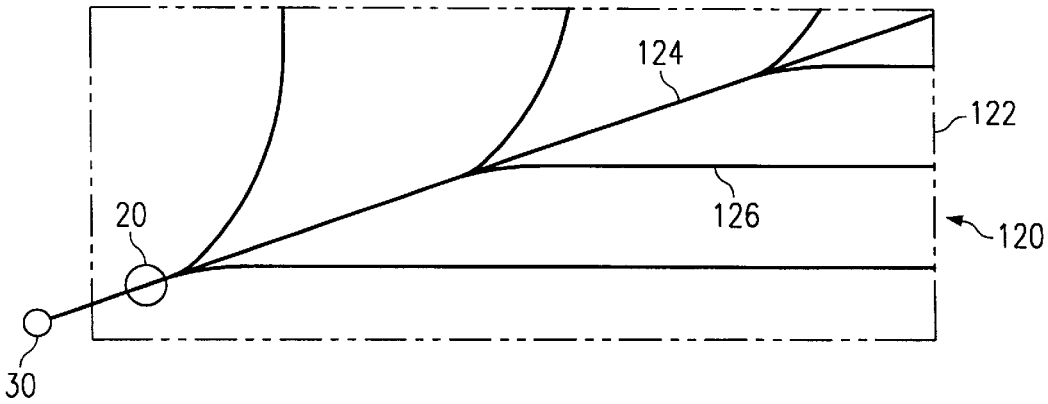
FIG. 5 is a top plan diagram illustrating a pinnate drainage pattern for accessing deposits in a subterranean zone in accordance with another embodiment of the present invention.

FIG. 5 illustrates a pinnate drainage pattern 120 in accordance with another embodiment of the present invention. In this embodiment, the pinnate drainage pattern 120 drains a substantially rectangular area 122 of the coal seam 15. The pinnate drainage pattern 120 includes a main diagonal bore 124 and a plurality of lateral bores 126 that are formed as described in connection with diagonal and lateral bores 104 and 110 of FIG. 4. For the substantially rectangular area 122, however, the lateral bores 126 on a first side of the diagonal 124 include a shallow angle while the lateral bores 126 on the opposite side of the diagonal 124 include a steeper angle to together provide uniform coverage of the area 12.

Figure 6:
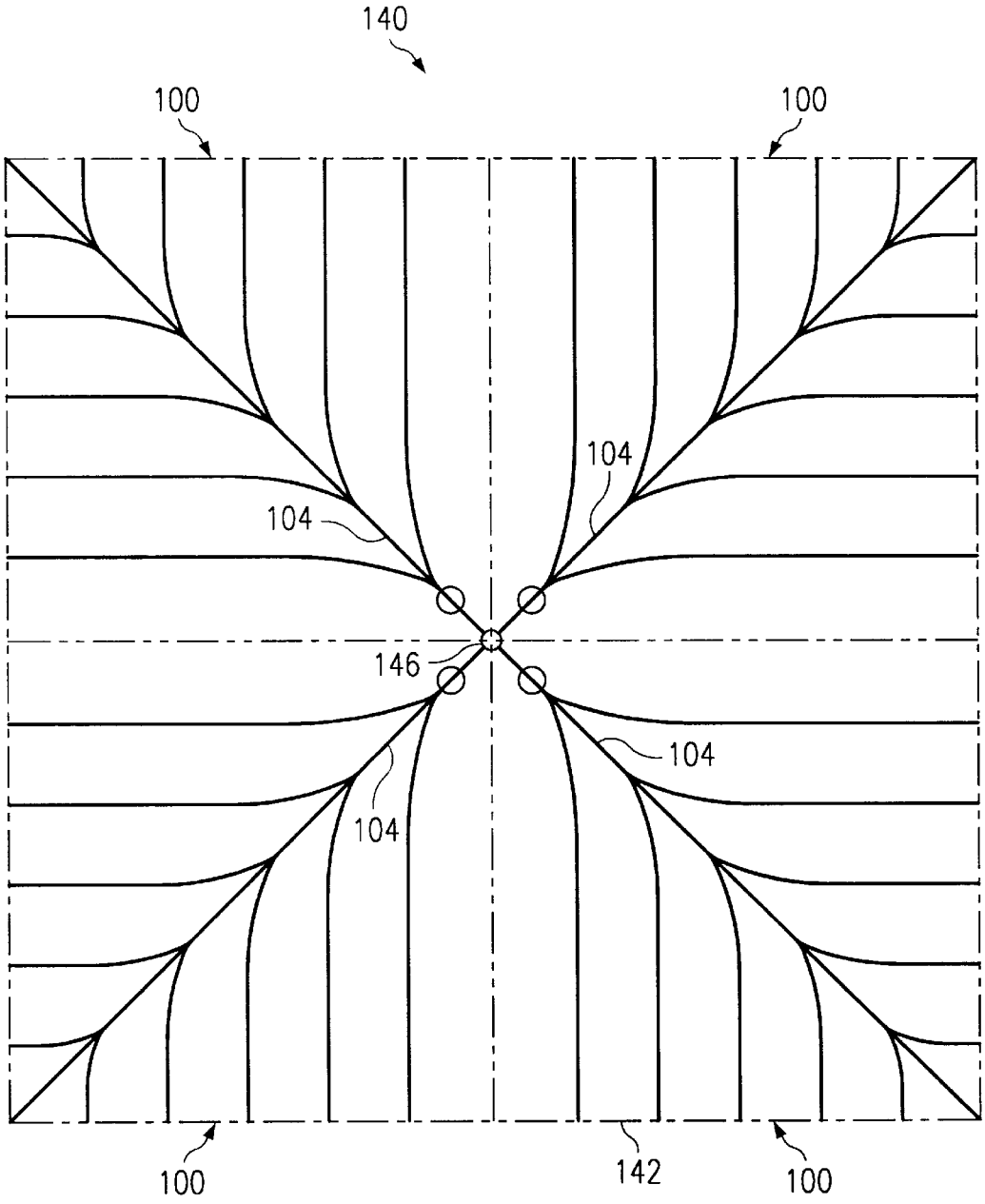
FIG. 6 is a top plan diagram illustrating a quadrilateral pinnate drainage pattern for accessing deposits in a subterranean zone in accordance with still another embodiment of the present invention.

FIG. 6 illustrates a quadrilateral pinnate drainage pattern 140 in accordance with another embodiment of the present invention. The quadrilateral drainage pattern 140 includes four discrete pinnate drainage patterns 100 each draining a quadrant of a region 142 covered by the pinnate drainage pattern 140.

Each of the pinnate drainage patterns 100 includes a diagonal well bore 104 and a plurality of lateral well bores 110 extending from the diagonal well bore 104. In the quadrilateral embodiment, each of the diagonal and lateral bores 104 and 110 are drilled from a common articulated well bore 141. This allows tighter spacing of the surface production equipment, wider coverage of a drainage pattern and reduces drilling equipment and operations.

Figure 7:
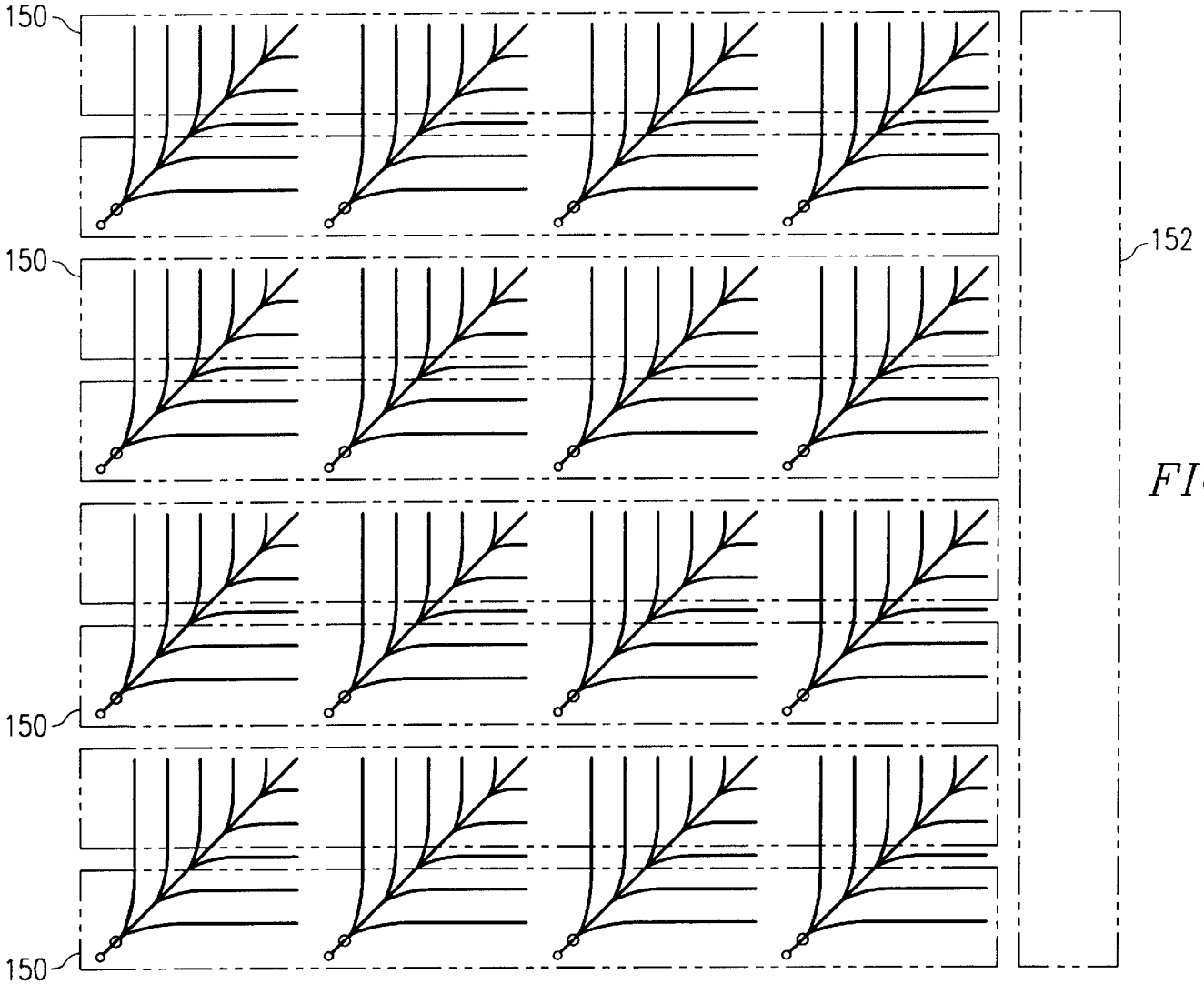
FIG. 7 is a top plan diagram illustrating the alignment of pinnate drainage patterns within panels of a coal seam for degasifying and preparing the coal seam for mining operations in accordance with one embodiment of the present invention.

FIG. 7 illustrates the alignment of pinnate drainage patterns 100 with subterranean structures of a coal seam for degasifying and preparing the coal seam for mining operations in accordance with one embodiment of the present invention. In this embodiment, the coal seam 15 is mined using a longwall process. It will be understood that the present invention can be used to degasify coal seams for other types of mining operations.

Referring to FIG. 7, coal panels 150 extend longitudinally from a longwall 152. In accordance with longwall mining practices, each panel 150 is subsequently mined from a distant end toward the longwall 152 and the mine roof allowed to cave and fracture into the opening behind the mining process. Prior to mining of the panels 150, the pinnate drainage patterns 100 are drilled into the panels 150 from the surface to degasify the panels 150 well ahead of mining operations. Each of the pinnate drainage patterns 100 is aligned with the longwall 152 and panel 150 grid and covers portions of one or more panels 150. In this way, a region of a mine can be degasified from the surface based on subterranean structures and constraints.

Figure 8:
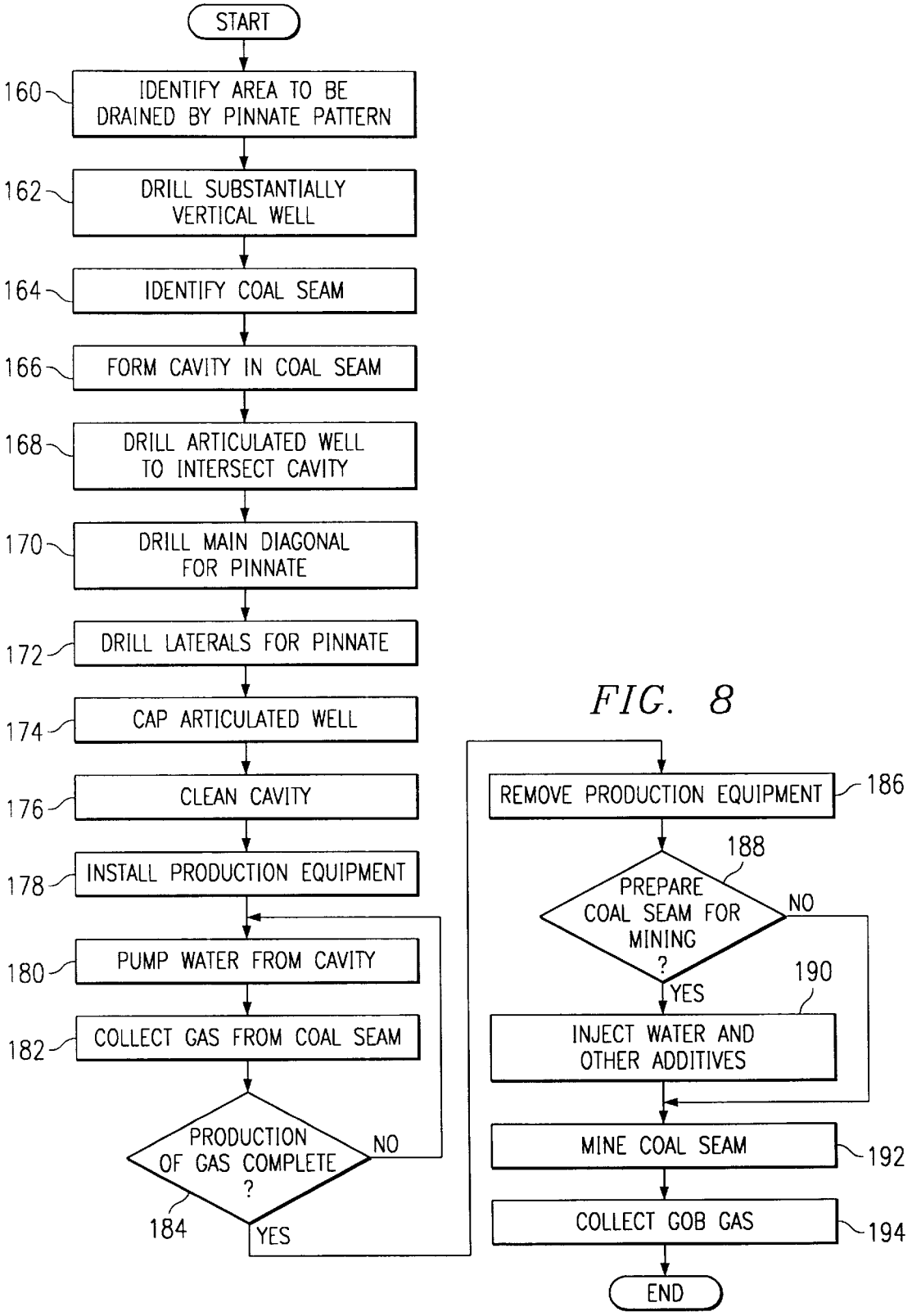
FIG. 8 is a flow diagram illustrating a method for preparing a coal seam for mining operations in accordance with one embodiment of the present invention.

FIG. 8 is a flow diagram illustrating a method for preparing the coal seam 15 for mining operations in accordance with one embodiment of the present invention. In this embodiment, the method begins at step 160 in which areas to be drained and drainage patterns 50 for the areas are identified. Preferably, the areas are aligned with the grid of a mining plan for the region. Pinnate structures 100, 120 and 140 may be used to provide optimized coverage for the region. It will be understood that other suitable patterns may be used to degasify the coal seam 15.

Proceeding to step 162, the substantially vertical well 12 is drilled from the surface 14 through the coal seam 15. Next, at step 164, down hole logging equipment is utilized to exactly identify the location of the coal seam in the substantially well bore 12. At step 164, the enlarged diameter cavity 22 is formed in the substantially vertical well bore 12 at the location of the coal seam 15. As previously discussed, the enlarged diameter cavity 20 may be formed by under reaming and other conventional techniques.

Next, at step 166, the articulated well bore 30 is drilled to intersect the enlarged diameter cavity 22. At step 168, the main diagonal bore 104 for the pinnate drainage pattern 100 is drilled through the articulated well bore 30 into the coal seam 15. After formation of the main diagonal 104, lateral bores 110 for the pinnate drainage pattern 100 are drilled at step 170. As previously described, lateral kick-off points may be formed in the diagonal bore 104 during its formation to facilitate drilling of the lateral bores 110.

At step 172, the articulated well bore 30 is capped. Next, at step 174, the enlarged diagonal cavity 22 is cleaned in preparation for installation of down-hole production equipment. The enlarged diameter cavity 22 may be cleaned by pumping compressed air down the substantially vertical well bore 12 or other suitable techniques. At step 176, production equipment is installed in the substantially vertical well bore 12. The production equipment includes a sucker rod pump extending down into the cavity 22 for removing water from the coal seam 15. The removal of water will drop the pressure of the coal seam and allow methane gas to diffuse and be produced up the annulus of the substantially vertical well bore 12.

Proceeding to step 178, water that drains from the drainage pattern 100 into the cavity 22 is pumped to the surface with the rod pumping unit. Water may be continuously or intermittently be pumped as needed to remove it from the cavity 22. At step 180, methane gas diffused from the coal seam 15 is continuously collected at the surface 14. Next, at decisional step 182 it is determined whether the production of gas from the coal seam 15 is complete. In one embodiment, the production of gas may be complete after the cost of the collecting the gas exceeds the revenue generated by the well. In another embodiment, gas may continue to be produced from the well until a remaining level of gas in the coal seam 15 is below required levels for mining operations. If production of the gas is not complete, the No branch of decisional step 182 returns to steps 178 and 180 in which water and gas continue to be removed from the coal seam 15. Upon completion of production, the Yes branch of decisional step 182 leads to step 184 in which the production equipment is removed.

Next, at decisional step 186, it is determined whether the coal seam 15 is to be further prepared for mining operations. If the coal seam 15 is to be further prepared for mining operations, the Yes branch of decisional step 186 leads to step 188 in which water and other additives may be injected back into the coal seam 15 to rehydrate the coal seam in order to minimize dust, to improve the efficiency of mining, and to improve the mined product.

Step 188 and the No branch of decisional step 186 lead to step 190 in which the coal seam 15 is mined. The removal of the coal from the seam causes the mined roof to cave and fracture into the opening behind the mining process. The collapsed roof creates gob gas which may be collected at step 192 through the substantially vertical well bore 12. Accordingly, additional drilling operations are not required to recover gob gas from a mined coal seam. Step 192 leads to the end of the process by which a coal seam is efficiently degasified from the surface. The method provides a symbiotic relationship with the mine to remove unwanted gas prior to mining and to rehydrate the coal prior to the mining process.

Figure 9C:
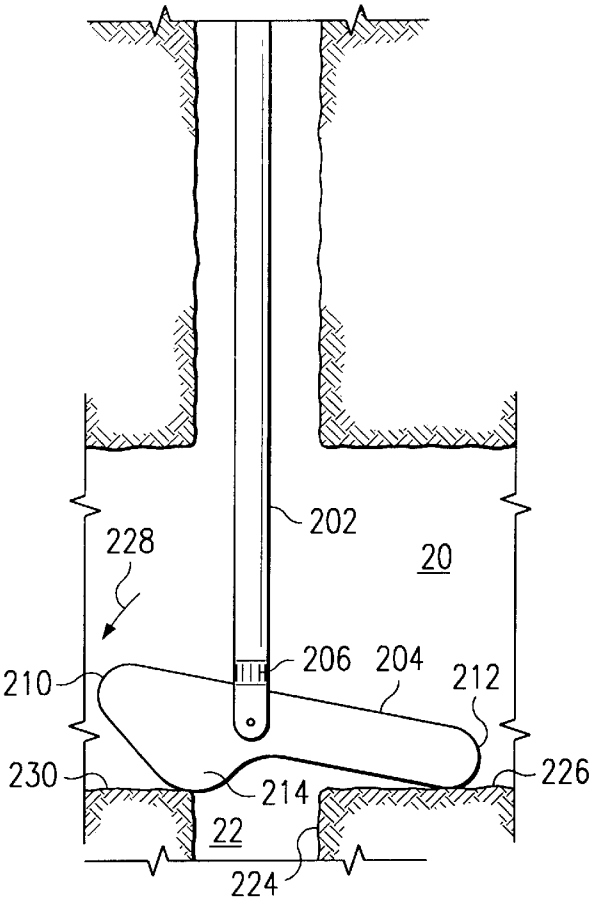
FIGS. 9A–9C are cross-sectional diagrams illustrating a cavity well positioning system in accordance with an embodiment of the present invention.
Figure 9B:
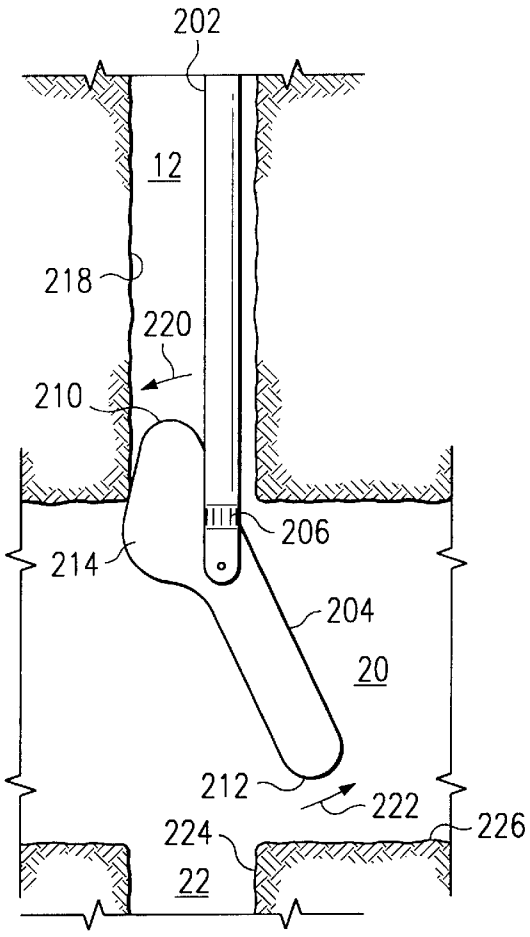
Figure 9A:
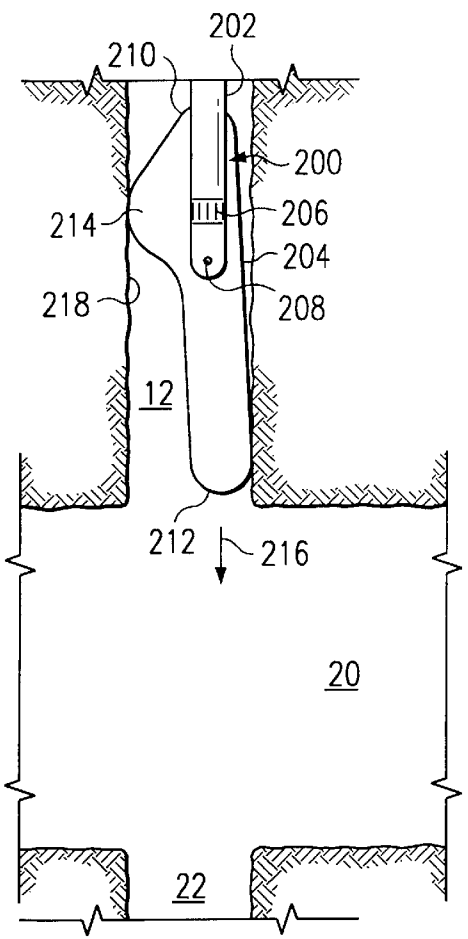

FIGS. 9A through 9C are diagrams illustrating a system for deployment of a well cavity pump 200 in accordance with an embodiment of the present invention. Referring to FIG. 9A, well cavity pump 200 comprises a well bore portion 202 and a cavity positioning device 204. Well bore portion 202 comprises an inlet 206 for drawing and transferring well fluid contained within cavity 20 to a surface of vertical well bore 12.

In this embodiment, cavity positioning device 204 is rotatably coupled to well bore portion 202 to provide rotational movement of cavity positioning device 204 relative to well bore portion 202. For example, a pin, shaft, or other suitable method or device (not explicitly shown) may be used to rotatably couple cavity position device 204 to well bore portion 202 to provide pivotal movement of cavity positioning device 204 about an axis 208 relative to well bore portion 202. Thus, cavity positioning device 204 may be coupled to well bore portion 202 between an end 210 and an end 212 of cavity positioning device 204 such that both ends 210 and 212 may be rotatably manipulated relative to well bore portion 202.

Cavity positioning device 204 also comprises a counter balance portion 214 to control a position of ends 210 and 212 relative to well bore portion 202 in a generally unsupported condition. For example, cavity positioning device 204 is generally cantilevered about axis 208 relative to well bore portion 202. Counter balance portion 214 is disposed along cavity positioning device 204 between axis 208 and end 210 such that a weight or mass of counter balance portion 214 counter balances cavity positioning device 204 during deployment and withdrawal of well cavity pump 200 relative to vertical well bore 12 and cavity 20.

In operation, cavity positioning device 204 is deployed into vertical well bore 12 having end 210 and counter balance portion 214 positioned in a generally retracted condition, thereby disposing end 210 and counter balance portion 214 adjacent well bore portion 202. As well cavity pump 200 travels downwardly within vertical well bore 12 in the direction indicated generally by arrow 216, a length of cavity positioning device 204 generally prevents rotational movement of cavity positioning device 204 relative to well bore portion 202. For example, the mass of counter balance portion 214 may cause counter balance portion 214 and end 212 to be generally supported by contact with a vertical wall 218 of vertical well bore 12 as well cavity pump 200 travels downwardly within vertical well bore 12.

Referring to FIG. 9B, as well cavity pump 200 travels downwardly within vertical well bore 12, counter balance portion 214 causes rotational or pivotal movement of cavity positioning device 204 relative to well bore portion 202 as cavity positioning device 204 transitions from vertical well bore 12 to cavity 20. For example, as cavity positioning device 204 transitions from vertical well bore 12 to cavity 20, counter balance portion 214 and end 212 become generally unsupported by vertical wall 218 of vertical well bore 12. As counter balance portion 214 and end 212 become generally unsupported, counter balance portion 214 automatically causes rotational movement of cavity positioning device 204 relative to well bore portion 202. For example, counter balance portion 214 generally causes end 210 to rotate or extend outwardly relative to vertical well bore 12 in the direction indicated generally by arrow 220. Additionally, end 212 of cavity positioning device 204 extends or rotates outwardly relative to vertical well bore 12 in the direction indicated generally by arrow 222.

The length of cavity positioning device 204 is configured such that ends 210 and 212 of cavity positioning device 204 become generally unsupported by vertical well bore 12 as cavity positioning device 204 transitions from vertical well bore 12 into cavity 20, thereby allowing counter balance portion 214 to cause rotational movement of end 212 outwardly relative to well bore portion 202 and beyond an annulus portion 224 of sump 22. Thus, in operation, as cavity positioning device 204 transitions from vertical well bore 12 to cavity 20, counter balance portion 214 causes end 212 to rotate or extend outwardly in the direction indicated generally by arrow 222 such that continued downward travel of well cavity pump 200 results in contact of end 12 with a horizontal wall 226 of cavity 20.

Referring to FIG. 9C, as downwardly travel of well cavity pump 200 continues, the contact of end 212 with horizontal wall 226 of cavity 20 causes further rotational movement of cavity positioning device 204 relative to well bore portion 202. For example, contact between end 212 and horizontal 226 combined with downward travel of well cavity pump 200 causes end 210 to extend or rotate outwardly relative to vertical well bore 12 in the direction indicated generally by arrow 228 until counter balance portion 214 contacts a horizontal wall 230 of cavity 20. Once counter balance portion 214 and end 212 of cavity positioning device 204 become generally supported by horizontal walls 226 and 230 of cavity 20, continued downward travel of well cavity pump 200 is substantially prevented, thereby positioning inlet 206 at a predefined location within cavity 20.

Thus, inlet 206 may be located at various positions along well bore portion 202 such that inlet 206 is disposed at the predefined location within cavity 20 as cavity positioning device 204 bottoms out within cavity 20. Therefore, inlet 206 may be accurately positioned within cavity 20 to substantially prevent drawing in debris or other material disposed within sump or rat hole 22 and to prevent gas interference caused by placement of the inlet 20 in the narrow well bore. Additionally, inlet 206 may be positioned within cavity 20 to maximize fluid withdrawal from cavity 20.

In reverse operation, upward travel of well cavity pump 200 generally results in releasing contact between counter balance portion 214 and end 212 with horizontal walls 230 and 226, respectively. As cavity positioning device 204 becomes generally unsupported within cavity 20, the mass of cavity positioning device 204 disposed between end 212 and axis 208 generally causes cavity positioning device 204 to rotate in directions opposite the directions indicated generally by arrows 220 and 222 as illustrated FIG. 9B. Additionally, counter balance portion 214 cooperates with the mass of cavity positioning device 204 disposed between end 212 and axis 208 to generally align cavity positioning device 204 with vertical well bore 12. Thus, cavity positioning device 204 automatically becomes aligned with vertical well bore 12 as well cavity pump 200 is withdrawn from cavity 20. Additional upward travel of well cavity pump 200 then may be used to remove cavity positioning device 204 from cavity 20 and vertical well bore 12.

Therefore, the present invention provides greater reliability than prior systems and methods by positively locating inlet 206 of well cavity pump 200 at a predefined location within cavity 20. Additionally, well cavity pump 200 may be efficiently removed from cavity 20 without requiring additional unlocking or alignment tools to facilitate the withdrawal of well cavity pump 200 from cavity 20 and vertical well bore 12.

Although the present invention has been described with several embodiments, various changes and modifications may be suggested to one skilled in the art. It is intended that the present invention encompass such changes and modifications as fall within the scope of the appended claims.

What is claimed is:

1. A cavity well pump comprising:

a well bore portion having an inlet operable to draw well fluid from a subterranean cavity; and a cavity positioning device rotatably coupled to the well bore portion, the cavity positioning device operable to rotate from a first position to a second position within the subterranean cavity to position the inlet at a predefined location within the subterranean cavity.

2. The cavity well pump of claim 1, wherein the cavity positioning device automatically extends from the first position to the second position as the cavity positioning device transitions from a vertical well bore to the subterranean cavity.

3. The cavity well pump of claim 2, wherein the cavity positioning device is further operable to retract from the second position to the first position as the cavity positioning device is withdrawn from the subterranean cavity.

4. The cavity well pump of claim 1, wherein the cavity positioning device comprises a first end and a second end, the cavity positioning device pivotally coupled to the well portion between the first and second ends, the cavity positioning device having a counterbalance portion disposed on the first end and operable to rotate the second end outwardly into the subterranean cavity as the cavity positioning device transitions from a vertical well bore into the subterranean cavity.

5. The cavity well pump of claim 4,wherein the counterbalance portion is further operable to align the cavity positioning device with the vertical well bore for withdrawal of the cavity positioning device from the subterranean cavity.

6. The cavity well pump of claim 1, wherein the cavity positioning device comprises a first end and a second end, the first and second ends operable to extend outwardly in substantially opposite directions to dispose the cavity positioning device in the second position, and wherein the cavity positioning device is operable to contact a portion of the subterranean cavity to position the inlet in the predefined location.

7. The cavity well pump of claim 1, wherein the cavity positioning device contacts a portion of the subterranean cavity in the second position to substantially prevent downward travel of the inlet into a sump.

8. A subterranean cavity positioning system comprising:

a down-hole device having a well portion; and a cavity positioning device rotatably coupled to the well portion of the down-hole device, the cavity positioning device having a counterbalance portion operable to automatically rotate the cavity positioning device from a retracted position to an extended position as the cavity positioning device transitions from a well bore into the subterranean cavity.

9. The system of claim 8, wherein the counterbalance portion is further operable to automatically rotate the cavity positioning device from the extended position to the retracted position as the cavity positioning device is withdrawn from the subterranean cavity.

10. The system of claim 8, wherein the cavity positioning device comprises a first end and a second end, the counterbalance portion disposed at the first end, and wherein the second end is operable to contact a wall of the subterranean cavity to rotate the counterbalance portion into contact with the wall of the subterranean cavity to substantially prevent downward travel of the down-hole device.

11. The system of claim 8, wherein the counterbalance portion is further operable to align the cavity positioning device with the well bore as the cavity positioning device is withdrawn from the subterranean cavity.

12. The system of claim 8, wherein the down-hole device comprises a pump, and wherein the cavity positioning device is coupled to the well portion of the pump to position an inlet of the pump at a predefined location within the subterranean cavity.

13. A method for positioning down-hole equipment in a cavity, comprising:

providing a cavity positioning device coupled to a well bore portion of a down-hole device, the cavity positioning device having a counterbalance portion, the counterbalance portion causing rotation of the cavity positioning device to the extended position;

deploying the down-hole device and the cavity positioning device into a well bore, the cavity positioning device disposed in a retracted position relative to the well bore;

running the down-hole device and the cavity positioning device downwardly within the well bore to the cavity, the cavity positioning device automatically rotating to an extended position relative to the well bore in the cavity; and positioning the down-hole device at a predefined location in the cavity by contacting a portion of the cavity with the rotated cavity positioning device.

14. A method for positioning down-hole equipment in a cavity, comprising:

providing a cavity positioning device coupled to a well bore portion of a down-hole device;

deploying the down-hole device and the cavity positioning device into a well bore, the cavity positioning device disposed in a retracted position relative to the well bore;

running the down-hole device and the cavity positioning device downwardly within the well bore to the cavity, the cavity positioning device automatically rotating to an extended position relative to the well bore in the cavity;

positioning the down-hole device at a predefined location in the cavity by contacting a portion of the cavity with the rotated cavity positioning device;

releasing contact between the cavity positioning device and the portion of the cavity, releasing contact automatically transitioning the cavity positioning device from the extended position to the retracted position; and withdrawing the down-hole device and the cavity positioning device from the cavity and the well bore.

15. The method of claim 14 wherein automatically transitioning to the retracted position comprises automatically rotating the cavity positioning device from the extended position to the retracted position.

16. The method of claim 14, wherein automatically transitioning further comprises aligning the cavity positioning tool within the well bore.

* * * * *